United States Patent [19]
Verheyden
[11] 4,318,259
[45] Mar. 9, 1982

[54] REINFORCED CERAMIC FIBER PANEL FOR OVEN WALLS

[75] Inventor: Gerardus M. C. Verheyden, Doesburg, Netherlands

[73] Assignee: Heattreatment Advising Company N.V., Curacao, Netherlands Antilles

[21] Appl. No.: 137,019

[22] Filed: Apr. 4, 1980

[30] Foreign Application Priority Data

Apr. 13, 1979 [NL] Netherlands ..... 7902962

[51] Int. Cl.[3] ..... E04B 1/78

[52] U.S. Cl. ..... 52/404; 52/506; 110/336

[58] Field of Search ..... 52/506, 404; 110/332, 110/336

[56] References Cited

U.S. PATENT DOCUMENTS 3,854,262 12/1974 Brady ..... 52/506 X
3,990,203 11/1976 Gseaves ..... 52/506 X
4,045,924 9/1977 Jones ..... 110/332 X
4,120,641 10/1978 Myles ..... 52/506 X
4,202,148 5/1980 Frahme et al. ..... 52/506 X
4,222,338 9/1980 Adams ..... 52/506 X
4,248,023 2/1981 Dunlap ..... 52/506

*Primary Examiner*—Price C. Faw, Jr.
*Assistant Examiner*—Carl D. Friedman
*Attorney, Agent, or Firm*—Diller, Ramik & Wight

[57] ABSTRACT

An oven in whose wall heat insulating material is used in the form of panels consisting of highly refractory, ceramic fibre material pressed against one another, said strips being fastened with the aid of a refractory adhesive material at right angles to a refractory base plate, said strips being provided with reinforcements whereby the reinforcement is formed by tubes of highly refractory, ceramic material arranged in channels formed by registering holes in consecutive strips.

13 Claims, 8 Drawing Figures

REINFORCED CERAMIC FIBER PANEL FOR OVEN WALLS

Figure 1:
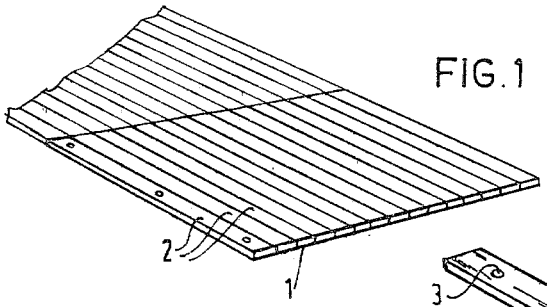

The invention relates to an oven in whose wall thermally insulating material is used in the form of panels consisting of highly refractory ceramic fibre material pressed one against the other, said strips being secured with the aid of a refractory adhesive material at right angles to a refractory base plate, said strips having reinforcements arranged in them. Such an oven is known from U.S. Pat. No. 3,990,203. The panels employed are self-supporting and constitute themselves the wall of the oven. This provides the advantage that the thermal capacity is limited so that energy consumption is low.

This known oven has, however, the disadvantage that in order to obtain a self-supporting structure wall panels are used in which reinforcements are included. The reinforcements are formed by T-section steel rods. At high temperatures in given firing processes gases are released, which attack the metal. Moreover, due to the temperature variations the rods will warp resulting in deformation of the panels and an insufficient seal between the panels. This causes considerable loss of heat. Moreover, due to the steel reinforcement the panels are heavy.

The invention has for its object to obviate these disadvantages. This is achieved by forming the reinforcement from tubes of highly refractory, ceramic material arranged in registering holes in the consecutive strips forming channels.

By using this form of reinforcement the panels and hence the oven walls will maintain their form even at very high temperatures. The oven wall is preferably arranged inside a frame, which may consist of steel tubing. For the supplementary fastening of the panels tubes of highly refractory, ceramic material can be placed at right angles to the base plate through holes in the wall of which the tubes extending through the channels are passed. These tubes projecting at right angles to the base plate can be secured by brackets to the tubes of the frame.

The base place may project beyond the strips of fibre material. Thus two orthogonal walls can be obtained, whilst the fibre material of one wall joins that of the other wall at right angles to the former in sealing relationship. From the bottom wall preferably extend in upward direction refractory, ceramic pipes filled with insulating material. On these pipes can be deposited the conventional ceramic carrier plates with the objects to be baked. In this way the vulnerable fibres of the oven wall are protected against damage.

The oven wall may be constructed from a plurality of panels placed one against the other in the direction of length of the wall, and having insulating material sandwiched between them. This particularly applies to larger ovens composed of sections. The panels can be pressed to one another by metal braces.

The frame is shut on the outer side preferably by sheet material arranged at a distance of at least 50 mms from the oven wall. Between the oven wall and the sheet material a hollow space is formed, through which a coolant, for example air, can circulate.

The invention will be described more fully with reference to the drawings.

The drawing show in

Figure 2:
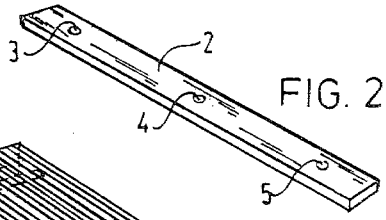
Figure 3:
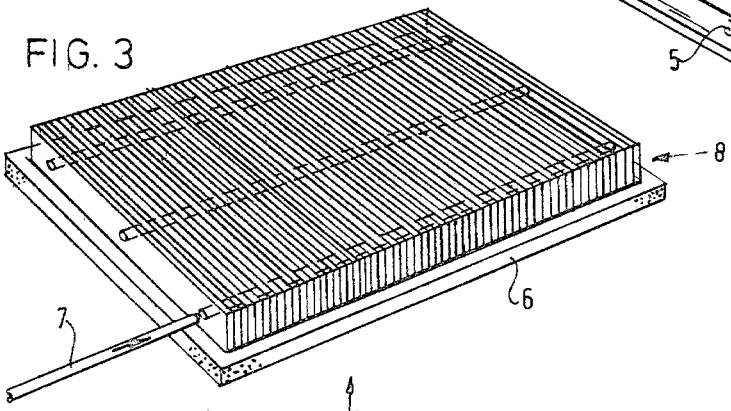
Figure 4:
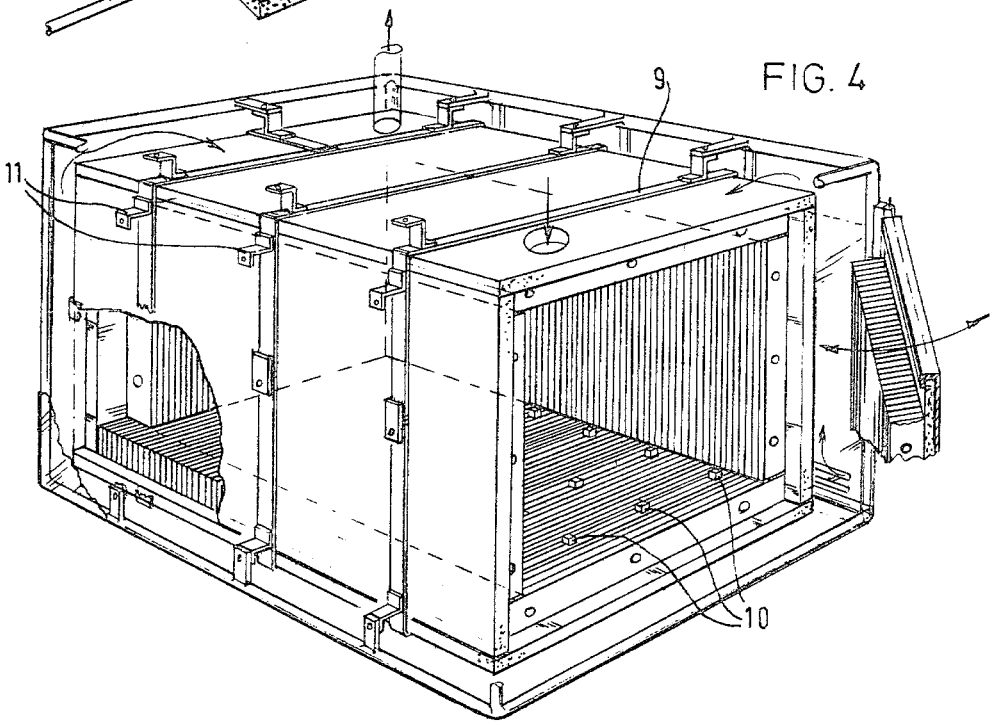
Figure 5:
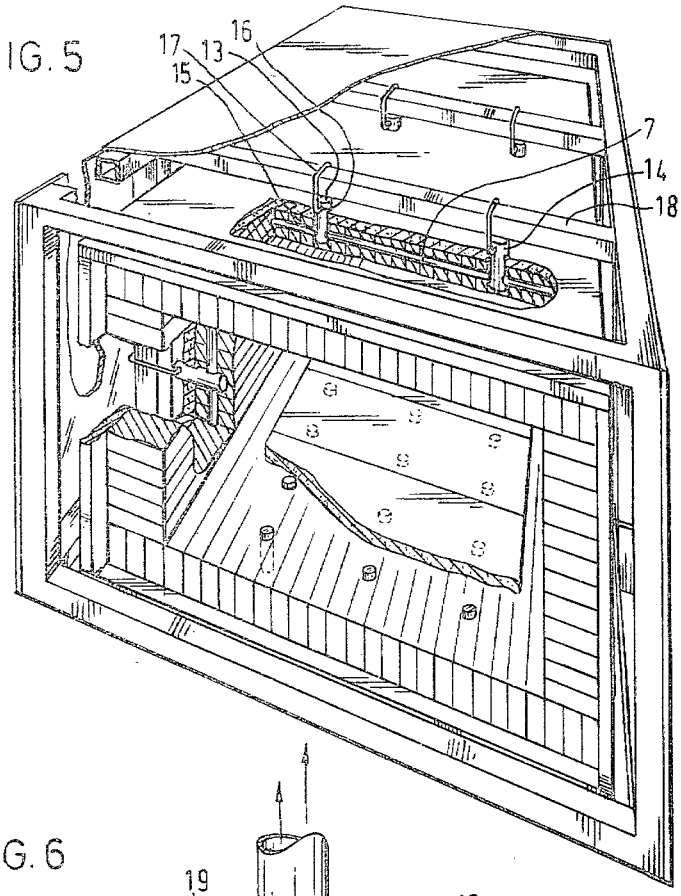
Figure 6:
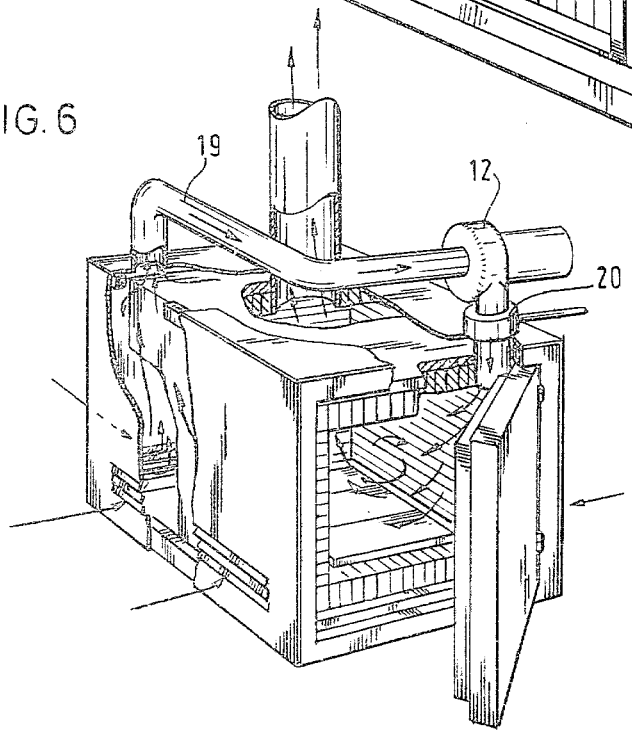
Figure 7:
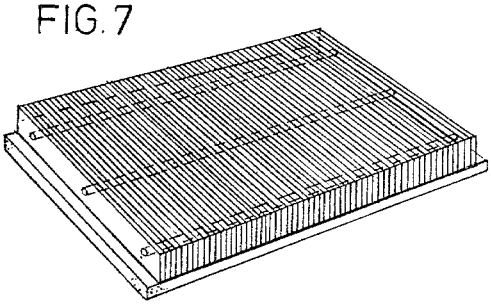
Figure 8:
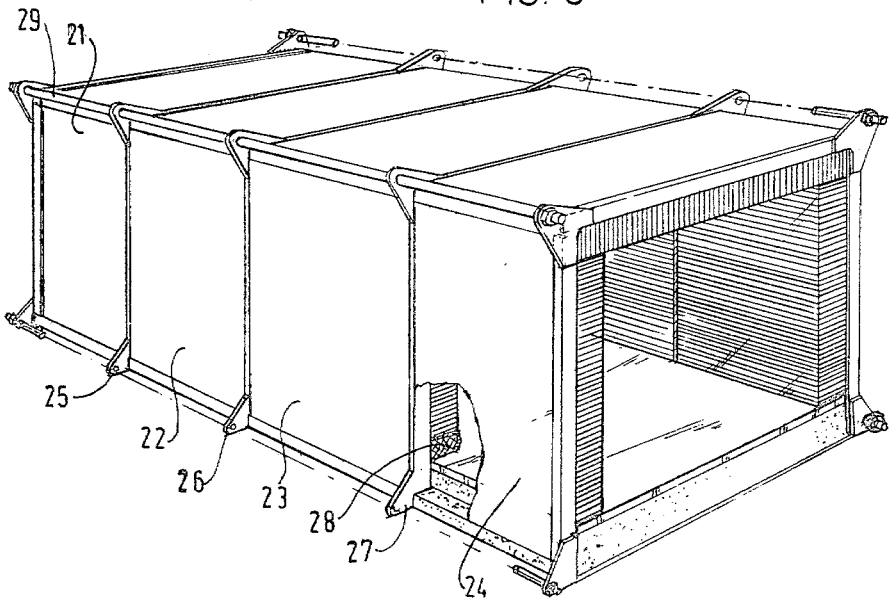

FIGS. 1 to 3 the method of manufacturing of a panel in accordance with the invention, FIGS. 4 to 6 perspective views of various embodiments of ovens in accordance with the invention, FIG. 7 a variant of the panel in accordance with the invention and FIG. 8 a large oven constructed from panels shown in FIG. 7.

The fibre material is provided in the form of a blanket 1 by a production machine. In the direction of length of the blanket strips, for example 2, are formed. Holes 3, 4 and 5 are made in each strip. Then the strips are turned through 90° and the holes are caused to register. The strips are fastened by refractory adhesive material to a refractory base plate 6. Subsequently the tube of ceramic material 7 is passed into the channels formed by the registering holes. Owing to the reinforcement formed by the ceramic tubes 7 the panel 8 becomes selfsupporting and may be handled as a single unit, large spans and dimensions of, for example, 200 to 300 cms being possible.

In order to form an oven the panels 8 are pressed together by metal braces 9. Since the base plate 6 projects beyond the fibre material, the orthogonal wall parts can join one another so that the fibre material contacts, leakage of heat being thus excluded. On the bottom of the oven can be arranged ceramic pipes 10 filled with insulating material, on which trays with the objects to be baked can be deposited in order to avoid damage of the fibre material. The frame may be shut on the outer side by metal sheets, which may be fastened, for example, by the braces 11. Through the cavity space thus formed air can circulate (see the arrows in FIGS. 4 and 6); this air may be conducted to the burners shown schematically on the top side. The air can be sucked in by a blower 12, which serves at the same time as a communication air fan. At right angles to the base plate 6 can be passed short ceramic pipes across the base plate into the fibre material. These short pipes, for example 13 and 14 (see FIG. 5), have at the two end portions openings 15 and 16. Through the opening 15 is passed a ceramic tube 7, whereas a bracket 17 is passed through the opening 16 for fastening to the frame beam 18. In this way a panel can be suspended to the frame.

From FIG. 6 it is apparent that the air sucked in circulates through the cavity space between the oven wall and the sheets of the frame, it is then conducted through the pipeline 19 via the fan 12 to a burner illustrated schematically by a member 20 and it enters as heating air the oven space, which it leaves approximately diagonally opposite the entrance place.

The oven of FIG. 8 is a very large oven intended, for example, for making bricks. With regard to the size the oven is composed of sections 21, 22, 23 and 24. Here panels as shown in FIG. 7 are used. The sections composed of panels are placed in contact with one another in the direction of length of the oven with the head sides of the strips of fibre material in contact with one another and drawn one against the other by pull rods with eyelets, for example, 25, 26 and 27. Compressible insulating material is arranged in the seam, for example, 28. A pull-rod connection 29 may be arranged throughout the length of the oven.

The weight and the mass of the oven according to the invention are particularly low so that the thermal capacity is considerably lower than that of the known oven. Consequently energy consumption is proportionally lower.

It should be noted that very large spans can be obtained, since the strips are cut in the direction of length from the blanket 1, provided the strips are reinforced in accordance with the invention.

Since a substantially seamless unit is obtained after the assembling of the panels, any shrinkage of the fibre material will not have any effect on the quality of the oven.

I claim:

1. An oven in whose wall heat insulating material is used in the form of panels consisting of strips of highly refractory, ceramic fibre material pressed against one another, said strips being fastened with the aid of a refractory adhesive material at right angles to a refractory base plate, said strips being provided with reinforcements characterized in that the reinforcement is formed by tubes of highly refractory, ceramic material arranged in channels formed by registering holes in consecutive strips.

2. An oven as claimed in claim 1 characterized in that tubes of highly refractory, ceramic material are passed through holes at right angles to the base plate, in the wall of which tubes extending through the channels are passed.

3. An oven as claimed in claims 1 or 2 characterized in that the base plate extends beyond the strips of fibre material.

4. An oven as claimed in claim 3 characterized in that from the bottom wall extend in upward direction refractory, ceramic pipes filled out with insulating material.

5. An oven as claimed in claim 3 characterized in that the oven wall is composed of a plurality of panels arranged in contact with one another in the direction of length of the wall, insulating material being sandwiched between them.

6. An oven as claimed in claim 3 characterized in that the oven is shut on the outer side by sheet material spaced apart from the oven wall by a distance of at least 50 mms.

7. An oven as claimed in claims 1 or 2 characterized in that from the bottom wall extend in upward direction refractory, ceramic pipes filled out with insulating material.

8. An oven as claimed in claim 7 characterized in that the oven wall is composed of a plurality of panels arranged in contact with one another in the direction of length of the wall, insulating material being sandwiched between them.

9. An oven as claimed in claim 7 characterized in that the oven is shut on the outer side by sheet material spaced apart from the oven wall by a distance of at least 50 mms.

10. An oven as claimed in claims 1 or 2 characterized in that the oven wall is composed of a plurality of panels arranged in contact with one another in the direction of length of the wall, insulating material being sandwiched between them.

11. An oven as claimed in claim 10 characterized in that the oven is shut on the outer side by sheet material spaced apart from the oven wall by a distance of at least 50 mms.

12. An oven as claimed in claims 1 or 2 characterized in that the frame is shut on the outer side by sheet material spaced apart from the oven wall by a distance of at least 50 mms.

13. A heat insulating oven wall construction comprising, in combination:

a refractory base plate having a planar surface area and an assembly of refractory strips covering said surface, said assembly being adhesively bonded to said surface area and comprising a plurality of said refractory strips, each being made of highly refractory ceramic fiber material and having a plurality of holes therein, said strips being stacked to form said assembly and presenting exposed side edges defining a bonding surface conforming to and abutting said planar surface of the base plate with the holes of said strips being aligned to present channels therethrough; and a highly refractory ceramic reinforcing tube arranged in each of said channels.

* * * * *